US011927188B2

(12) United States Patent
Conrad et al.

(10) Patent No.: US 11,927,188 B2
(45) Date of Patent: Mar. 12, 2024

(54) GEROTOR AND PUMP APPARATUS HAVING A GEROTOR DEVICE

(71) Applicant: MAHLE International GmbH, Stuttgart (DE)

(72) Inventors: Holger Conrad, Veilsdorf (DE); Torsten Klein, Hildburghausen (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 18/119,262

(22) Filed: Mar. 8, 2023

(65) Prior Publication Data

US 2023/0287884 A1 Sep. 14, 2023

(30) Foreign Application Priority Data

Mar. 9, 2022 (DE) ..... 10 2022 202 358.7

(51) Int. Cl.
*F04C 2/10* (2006.01)
*F04C 11/00* (2006.01)

(52) U.S. Cl.
CPC ..... *F04C 2/102* (2013.01); *F04C 11/001* (2013.01)

(58) Field of Classification Search
CPC ..... F04C 2/102; F04C 11/001
See application file for complete search history.

(56) References Cited

U.S. PATENT DOCUMENTS 1,968,113 A * 7/1934 Weaver ..... F01C 21/008 418/171
3,453,966 A * 7/1969 Eddy ..... F04C 11/001 418/61.3
4,658,583 A * 4/1987 Shropshire ..... F04C 14/02 137/565.31
6,195,990 B1 3/2001 Machesney
(Continued)

FOREIGN PATENT DOCUMENTS

DE 3432704 A1 3/1986
DE 60023839 T2 7/2006
(Continued)

OTHER PUBLICATIONS

German Patent Publication and Machine Translation for DE 10 2015 214 639 A1, Inventor: Wolf et al, Title: Gerotor, Published: Feb. 2, 2017. (Year: 2017).*
German Patent Publication & Translation for DE 10 2012 215 023 A1, Inventor: Helmut et al, Title: Internal Gear Pump Used as Hydraulic Pump for Fuel Injection System for Motor Car, Has Fluid Storage Space That is Formed Between Radially Outward Facing Surface of Ring Gear & Radially Inward Facing . . . (Year: 2014).*
(Continued)

*Primary Examiner* — Mary Davis
(74) *Attorney, Agent, or Firm* — Fishman Stewart PLLC

(57) ABSTRACT

A gerotor device for a pump apparatus is disclosed. The gerotor device includes at least two gerotor stages that respectively include an inner rotor rotating during operation about an inner axis with teeth projecting radially outside, and an outer rotor rotating during operation about an outer axis radially offset relative to the inner axis with radially inner open tooth gaps, in which the teeth of the inner rotor engage. A rotor body rotating during operation about a rotor axis includes radially open tooth gaps of a first gerotor stage
(Continued)

of the at least two gerotor stages and teeth projecting radially outside of a second gerotor stage of the at least two gerotor stages. The tooth gaps of the at least two gerotor stages are fluidically sealed at least one of against one another and relative to a surrounding area.

19 Claims, 5 Drawing Sheets

(56) References Cited

U.S. PATENT DOCUMENTS 7,845,922 B2 12/2010 Langenbach

FOREIGN PATENT DOCUMENTS

DE 102005047175 A1 4/2007
DE 102012215023 A1 1/2014

OTHER PUBLICATIONS

Chinese Patent Publication and Machine Translation for CN 1914429 A, Inventor: Kita et al, Title: Thrust Dynamic Pressure Bearing, Principal Axis Motor Using This Thrust Dynamic Pressure Bearing and Information Record and Reappear Device Using This Principal Axis Motor, Published: Feb. 14, 2007 (Year: 2007).*
English abstract for DE-34 32 704 , Printed Mar. 8, 2023.
English abstract for DE-10 2012 215 023 , Printed Mar. 8, 2023.

* cited by examiner

GEROTOR AND PUMP APPARATUS HAVING A GEROTOR DEVICE

CROSS-REFERENCE TO RELATED APPLICATION

This application claims priority to German Application No. 10 2022 202 358.7 filed on Mar. 9, 2022, the contents of which are hereby incorporated by reference in its entirety.

TECHNICAL FIELD

The present invention relates to a gerotor device having at least two gerotor stages, wherein the respective gerotor stage comprises an inner rotor and an outer rotor. Further, the invention relates to a pump apparatus having such a gerotor device and to a motor vehicle having such a pump apparatus.

BACKGROUND

A gerotor comprises an inner rotor and an outer rotor which during the operation rotate about axes radially offset relative to one another. The inner rotor comprises outside projecting teeth, which during the operation engage in tooth gaps of the outer rotor that are open radially inside in order to deliver a fluid, in particular a liquid. Accordingly, such gerotors are usually employed in pump apparatuses for pumping a liquid.

It is conceivable to form a gerotor device in multiple stages. Then, the gerotor device comprises at least two gerotors, each of which forms a gerotor stage. Accordingly it is possible for example to deliver a fluid stepped, i.e. with different volumetric flows or different fluids.

The present invention deals with the object of stating for a gerotor device of the type mentioned above for a pump apparatus having such a gerotor device and for a motor vehicle having such a pump apparatus, improved or at least other embodiments, which in particular remedy the disadvantages from the prior art. In particular, the present invention deals with the object of stating for the gerotor device, for the pump apparatus and for the motor vehicle embodiments which are characterised by a cost-effective and/or installation space-saving design and/or a reliable operation.

According to the invention, this object is solved through the subjects of the independent claim(s). Presentation of the embodiments are subject of the dependent claims.

SUMMARY

The present invention is based on the general idea of employing in a gerotor device having at least two gerotor stages, a rotor of one of the gerotor stages simultaneously as the rotor of another, preferably radially adjacent gerotor stage and sealing the gerotor stages against one another and/or relative to the surrounding area. Thus, the separate producing and/or mounting of these rotors in the gerotor device is not required. As a consequence, both the production and also the assembly of the gerotor device are simplified and cost-effective. In addition, the gerotor device can be more space-savingly designed in this manner. Similar applies to a pump apparatus having a gerotor device and to a motor vehicle having the pump apparatus. The sealing of the gerotor stages against one another and/or relative to the surrounding area results in that no or at least reduced internal leakages of the gerotor device occur, so that the operation of the gerotor device is more reliable. In this way, it is additionally avoided, further, that one of the gerotor stages, because of a pressure differential, is undesirably filled with sucked-in gas, for example air. This also results in increased reliability during the operation of the gerotor device.

According to the inventive idea, the gerotor device comprises two gerotor stages. The respective gerotor stage comprises an inner rotor and an outer rotor, each of which rotate during the operation about an associated axis, wherein the axes are radially offset relative to one another. The inner rotor comprises projecting teeth radially outside, which during the operation engage in open tooth gaps of the associated outer rotor radially inside. This means that the respective gerotor stage comprises an inner rotor rotating during the operation about an inner axis having projecting teeth radially outside and an outer rotor rotating during the operation about an outer axis offset radially relative to the inner axis, having tooth gaps that are open radially inside, in which during the operation the teeth of the inner rotor engage. A rotor body comprises both tooth gaps of one of the gerotor stages, which in the following is also referred to as gerotor stage, and also teeth of another gerotor stage, which in the following is also referred to as second gerotor stage. During the operation, the rotor body rotates about an associated axis, which in the following is also referred to as rotor axis. The gerotor device thus comprises the rotor body rotating during the operation about the rotor axis, which comprises open tooth gaps of the first gerotor stage radially inside and teeth of the second gerotor stage projecting radially outside. The tooth gaps of the gerotor stages and thus the gerotor stages are fluidically sealed against one another.

The "radial" direction respectively stated here refers to the associated axis. Accordingly, "axial" runs parallel or coaxially to the respective axis. The axes run in parallel.

Advantageously, the rotor axis of the rotor body advantageously corresponds to the outer axis of the first gerotor stage and the inner axis of the second gerotor stage. The outer axis of the first gerotor stage and the inner axis of the second gerotor stage thus coincide, consequently correspond to one another, and are formed by the rotor axis. Consequently, the rotor axis and the gerotor stages are matched to one another such that a parallel operation of both gerotor stages is possible.

The outer rotor of the second gerotor stage preferably encloses the rotor body radially outside. Thus, the first gerotor stage is a radially inner gerotor stage and the second gerotor stage a radially outer gerotor stage.

It is conceivable that the rotor body merely comprises a part of the tooth gaps of the first gerotor stage and/or a part of the teeth of the second gerotor stage.

Preferred are embodiments, in which the rotor body comprises all tooth gaps of the first gerotor stage and/or all teeth of the second gerotor stage. This means that embodiments are preferred in which the rotor body forms the inner rotor of the first gerotor stage and the outer rotor of the second gerotor stage. Thus, a simple, cost-effective and installation space-saving design of the gerotor device is achieved.

Advantageously, the gerotor device comprises a housing in which the gerotor stages, that is in particular the inner rotor, the rotor body and the outer rotor, are received.

The housing preferably comprises a housing pot with a radially extending pot bottom and a housing cover closing the housing pot located axially opposite the pot bottom. Housing pot and housing cover delimit a receiving volume in which the gerotor stages are received.

Conceivable are embodiments, in which the teeth and the tooth gaps of the rotor body are arranged at the same axial height. Thus, it is possible in particular to form the rotor body and consequently the gerotor device with a smaller axial extent and thus in a more installation space-saving manner.

It is advantageous when the inner rotor of the first gerotor stage, the rotor body and the outer rotor of the second gerotor stage axially terminate with one another, i.e. in particular axially on the front side, lie in a radially extending plane. Preferably, the inner rotor of the first gerotor stage, the rotor body and the outer rotor of the second gerotor stage each lie on both front sides in a radially extending plane each. This results in a particularly compact design of the gerotor device.

It is conceivable that the tooth gaps of the rotor body axially protrude over the teeth or vice versa. Thus, it is possible in particular to transmit higher moments with the first gerotor stage than with the second gerotor stage or vice versa.

Advantageously, the rotor body is formed axially stepped, i.e. comprises at least two steps radially offset relative to one another, which axially merge into one another. In particular, the rotor body comprises two steps, namely a radially inner step and a radially outer step. It is preferred when the radially inner step of the rotor body axially protrudes over the radially outer step of the rotor body and the outer rotor of the second gerotor stage. Thus, higher moments than by means of the second gerotor stage can be transmitted by means of the first gerotor stage in a simple and effective manner.

Basically, the rotor body can be formed in multiple parts. This means that the rotor body can comprise at least two parts produced separately and subsequently joined to one another. One of the parts can comprise the tooth gaps and the other part the teeth of the rotor body.

Preferred are embodiments, in which the rotor body is formed in one part and monolithically. This means that the rotor body preferably does not comprise any two or more parts which are separately produced and subsequently joined to one another. This results in a simple and cost-effective production of the rotor body.

The rotor body can be produced in any way.

It is conceivable to produce the rotor body by a primary moulding method, for example by injection moulding, in particular out of plastic. Thus, the rotor body can be in particular an injection moulded component.

It is likewise possible to produce the rotor body by sintering. Thus, the rotor body can be a sintered component.

It is to be understood that the gerotor device can also comprise three or more gerotor stages.

The gerotor stage can comprise two or more such rotor bodies that are separate from one another and/or spaced apart from one another, wherein the respective rotor body is assigned two gerotor stages that are, preferentially radially, adjacent to one another.

The sealing of the tooth gaps against one another and/or relative to the surrounding area can be realised in any way.

Preferably, the sealing of the tooth gaps against one another and/or relative to the surrounding area takes place by means of the rotor body.

For this purpose, the rotor body can comprise on at least one axial front side an axially open and circumferential groove.

In advantageous embodiments, the rotor body comprises on at least one axial front side an axially open and circumferential groove, which for sealing is filled with a liquid, in particular with oil. Thus, a simplified sealing of the tooth gaps materialises. The liquid, in particular the oil, is thus employed as sealing liquid. The liquid prevents suctioning a gas, in particular air, in the corresponding tooth gaps.

In advantageous embodiments, the rotor body comprises on at least one axial front side an axially open and circumferential groove and the housing for the respective at least one groove, an axially projecting and circumferential rib, which engages in the associated groove. Thus, the groove and the associated rib interact in the manner of a labyrinth seal in order to seal the tooth gaps. This results in a simple and reliable sealing of the tooth gaps against one another. In addition, this results in a simple and reliable sealing of the tooth gaps relative to the surrounding area and of the two gerotor stages against one another.

Basically, the rotor body can have such a groove merely on one of the front sides, and the housing thus merely comprise one such rib.

In preferred embodiments, the rotor body comprises such a groove on both axial front sides and the housing an associated such rib each for both grooves.

Accordingly, preferred are embodiments in which the rotor body comprises a first front side located axially opposite the pot bottom having a first groove and a second front side located axially opposite the housing cover having a second groove. The housing pot comprises a first rib projecting axially from the pot bottom, which engages in the first groove. In addition, the housing cover comprises an axially projecting second rib which engages in the second groove.

On at least one axial front side, the rotor body, in particular by means of the stepped design, can radially inside comprise an axially projecting cylindrical portion which in the following is also referred to as cylinder portion. Advantageously, the tooth gaps are formed at least partially in the cylinder portion, extend in particular axially into the cylinder portion. In addition, the cylinder portion preferably protrudes over the second gerotor stage.

With the respective at least one cylinder portion it is possible to mount the rotor body in the housing. The housing advantageously comprises for the respective at least one cylinder portion an associated receptacle directed axially to the inside, in which the associated cylinder portion engages.

In preferred embodiments, a sealing of the tooth gaps and thus gerotor stages against one another and/or the tooth gaps and thus the gerotor stages relative to the surrounding area, takes place by means of at least one of the at least one cylinder portion and/or of the associated receptacle. In particular it is possible to seal the cylinder portion and the associated receptacle radially. Accordingly, embodiments are preferred in which at least one of the at least one cylinder portion for sealing engages axially in the associated receptacle.

Embodiments prove to be advantageous in which the rotor body comprises on both axial front sides such a cylinder portion and the housing for the respective cylinder portion, an associated receptacle.

Accordingly, embodiments are advantageous in which the rotor body comprises a first cylinder portion projecting axially in the direction of the pot bottom and the housing pot comprises a first receptacle directed axially to the inside, in which the cylinder portion engages axially. In addition, the rotor body comprises a second cylinder portion projecting axially in the direction of the housing cover and the housing cover a second receptacle directed axially to the inside, in which the second cylinder portion engages axially.

The gerotor device is advantageously employed in a pump apparatus for pumping at least one fluid, advantageously at least one fluid. The pump apparatus comprises a cavity for receiving the gerotor device, through which a flow path of the at least one fluid leads.

It is conceivable to employ the pump apparatus in a motor vehicle in order to deliver in the motor vehicle at least one fluid, in particular a liquid. For example, oil and/or lubricant can be pumped with the pump apparatus. Thus, the pump apparatus is in particular an oil pump.

The pump apparatus can supply, for example in the motor vehicle, a transmission of the motor vehicle with liquid, in particular with oil and/or lubricant. This means that during the operation the pump apparatus supplies liquid, in particular oil and/or lubricant to the transmission by means of the gerotor device.

It is conceivable with the gerotor stages of the gerotor device to deliver and thus pump the same fluid in different pumping stages, i.e. with different volumetric flows and/or pressures. Thus, a flow path of the fluid leads through the cavity. It is conceivable to employ a gerotor stage as pre-stage of another gerotor stage. In particular, a first gerotor stage can serve as pressure stage for the fluid supply, in particular for the oil supply, and a second gerotor stage as suction stage for supplying the first gerotor stage.

It is likewise conceivable by means of the gerotor device to deliver at least two different fluids, wherein the respective fluid is assigned at least one gerotor stage. Thus, at least two flow paths lead through the receptacle separately from one another.

It is likewise conceivable to deliver by means of the gerotor device the same fluid in at least two circuits that are separate from one another, wherein the respective circuit is assigned a gerotor stage. Thus, at least two flow paths lead through the cavity separately from one another. It is conceivable to deliver the fluid in the different circuits with different volumetric flows and/or pressures.

As an example, a motor vehicle is referred to in which for example consumers, in particular oil consumers, requiring a low fluid pressure, for example for cooling a traction motor in the case of electrically driven vehicles, are present. In addition there are also consumers requiring a higher fluid pressure, in particular oil consumers, for example for lubricating bearings and/or a transmission. Here, both the consumers requiring a low fluid pressure and consumers requiring a higher fluid pressure can each be supplied by means of a gerotor stage. These consumers are advantageously incorporated in different circuits. The pump apparatus can be employed in any applications for pumping any fluids.

It is to be understood that the pump apparatus and the motor vehicle as such can also belong to the scope of this invention.

Further important features and advantages of the invention are obtained from the subclaims, from the drawings and from the associated figure description by way of the drawings.

It is to be understood that the features mentioned above and still to be explained in the following cannot only be used in the respective combination stated but also in other combinations or by themselves without leaving the scope of the present invention.

Preferred exemplary embodiments of the invention are shown in the drawings and are explained in more detail in the following description, wherein same reference numbers relate to same or similar or functionally same components.

BRIEF DESCRIPTION OF THE DRAWINGS

It shows, in each case schematically

DETAILED DESCRIPTION

Figure 1:
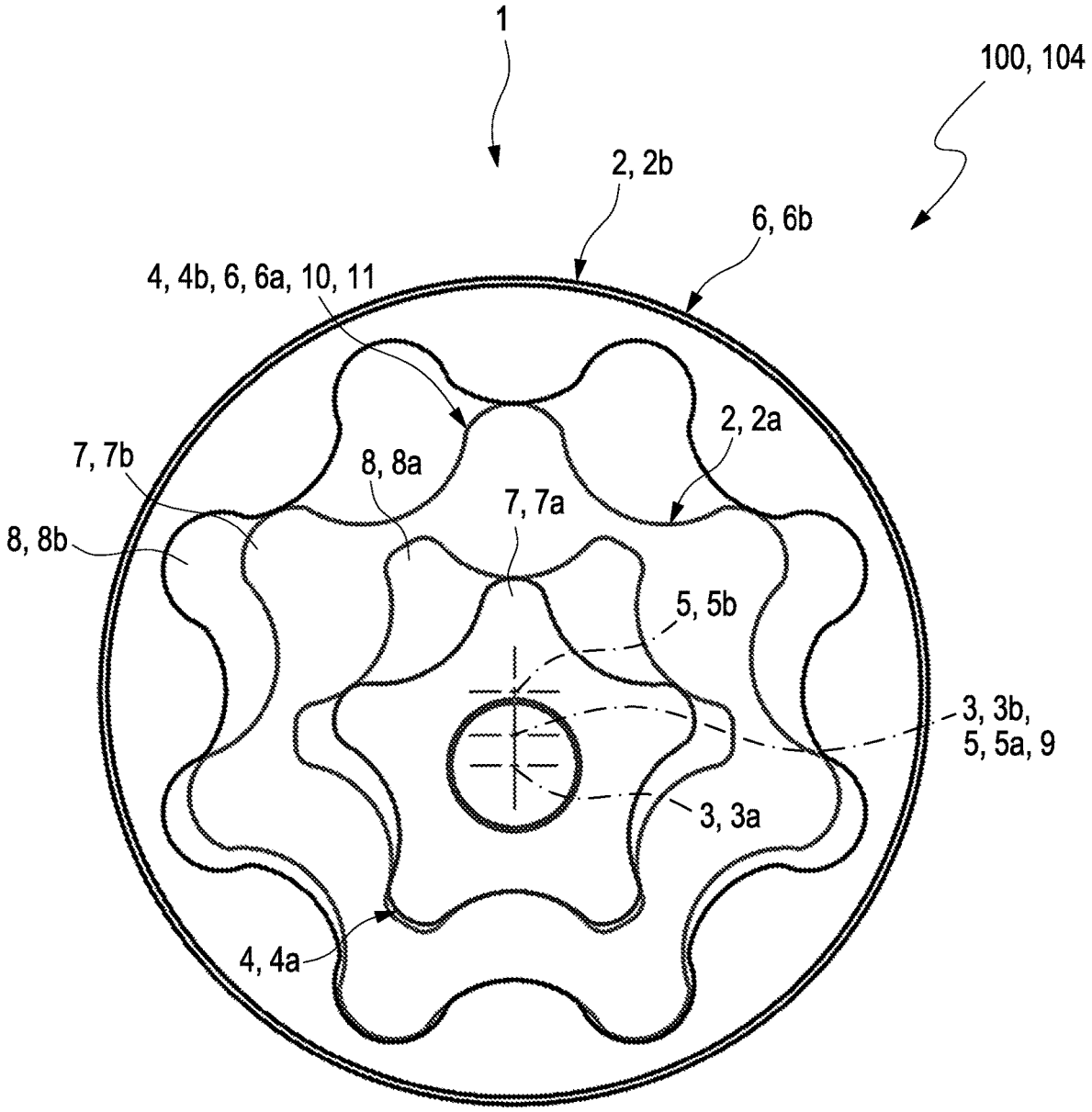
FIG. 1 an axial plan view of a gerotor device.
Figure 2:
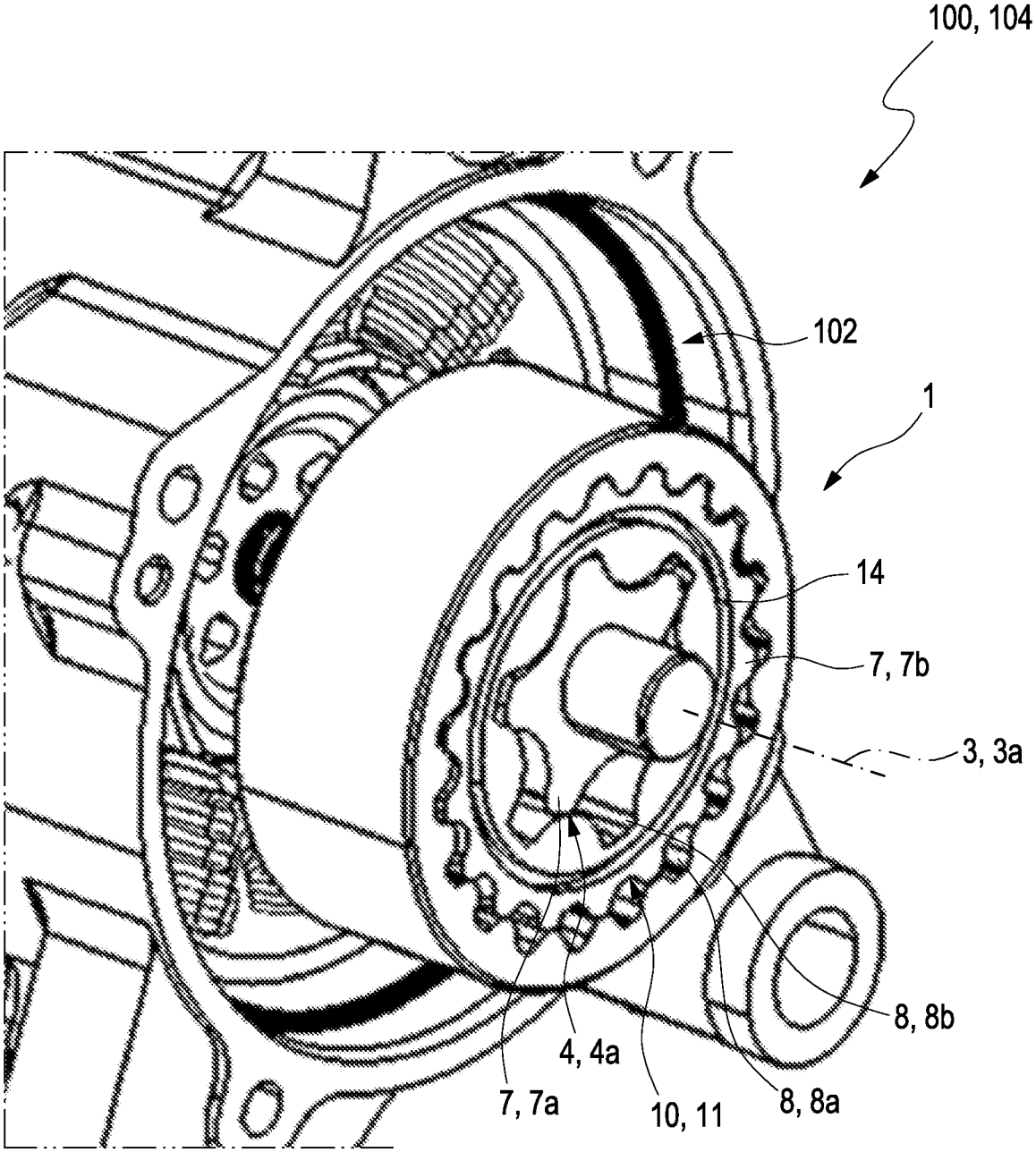
FIG. 2 an isometric view of a pump apparatus with the gerotor device.
Figure 3:
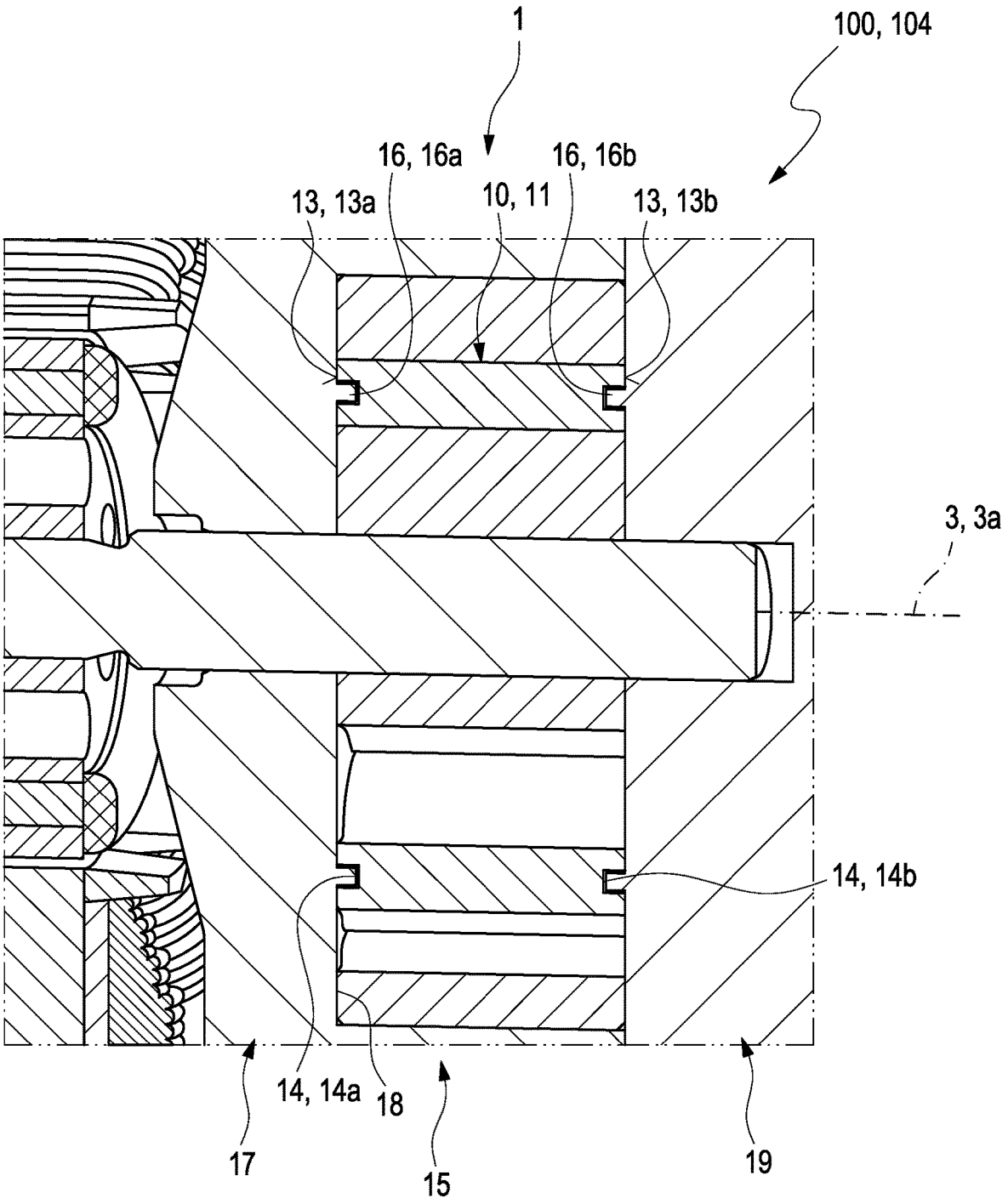
FIG. 3 a section through the pump apparatus with the gerotor device in another exemplary embodiment, FIG. 4 an isometric view of the gerotor device in a further exemplary embodiment, FIG. 5 a simplified lateral view of the gerotor device from FIG. 4, FIG. 6 a highly simplified representation in the manner of a circuit diagram of the pump apparatus in a motor vehicle, FIG. 7 a highly simplified representation in the manner of a circuit diagram of the pump apparatus in another exemplary embodiment.

A gerotor device 1, such as is shown for example in the FIGS. 1 to 7, is employed in a pump apparatus 100 shown for example in the FIGS. 2 and 3 as well as 6 and 7 for delivering at least one liquid. The gerotor device 1, as is evident in particular from FIG. 1, comprises at least two gerotor stages 2. In the shown exemplary embodiments, the gerotor device 1 comprises two gerotor stages 2, namely a first gerotor stage 2, 2*a* and a second gerotor stage 2, 2*b*. The respective gerotor stage 2 comprises an inner rotor 4 rotating during the operation about an inner axis 3 having projecting teeth 7 radially outside and an outer rotor 6 rotating during the operation about an outer axis 5 offset radially with respect to the inner axis 3 with tooth gaps 8 open radially inside, in which during the operation the teeth 7 of the inner rotor 4 engage. Thus, the first gerotor stage 2, 2*a* comprises a first inner rotor 4, 4*a* rotating during the operation about a first inner axis 3, 3*a* with first teeth 7, 7*a* projecting radially to the outside and a first outer rotor 6, 6*a* rotating during the operation about a first outer axis 5, 5*a* offset radially with respect to the first inner axis 3 with first tooth gaps 8, 8*a* open radially inside. During the operation, the first teeth 7, 7*a* of the first inner rotor 4, 4*a* engage in the tooth gaps 8, 8*a* of the first outer rotor 6, 6*a*. Similar to this, the second gerotor stage 2, 2*b* comprises a second inner rotor 4, 4*b* rotating during the operation about a second inner axis 3, 3*b* with second teeth 7, 7*b* projecting radially outside and a second outer rotor 6, 6*b* rotating during the operation about a second outer axis 5, 5*b* offset radially to the second inner axis with second tooth gaps 8, 8*b* open radially inside. During the operation, the second teeth 7, 7*b* of the second inner rotor 4, 4*b* engage in the second tooth gaps 8, 8*b* of the second outer rotor 6, 6*a*.

As is evident from the FIGS. 1 to 3, the gerotor device 1 comprises a rotor body 10 rotating during the operation about a rotor axis 9, which comprises radially open tooth gaps 8, 8*a* of the first gerotor stage 2, 2*a* and teeth 7, 7*b* of the second gerotor stage 2, 2*b* projecting radially to the outside. In the shown exemplary embodiments, the rotor body 10 forms the inner rotor 4, 4*a* of the first gerotor stage 2, 2*a* and the outer rotor 6, 6*b* of the second gerotor stage 2, 2*b*. Thus, the rotor body 10 comprises the first tooth gaps 8, 8*a* open radially inside of the first gerotor stage 2, 2*a* and the second teeth 8, 8*b* projecting radially outside of the second gerotor stage 2, 2*b*.

The direction "radial" stated here refers to the respective associated axis 3, 5, 9. The axes 3, 5, 9 run parallel. The direction "axial" stated here relates to the respectively associated axis 3, 5, 9, wherein axial runs parallel or coaxially to the axis.

In the shown exemplary embodiments, the rotor body 10 is formed in one part and monolithically. The rotor body 10 is for example a sintered component 11. The rotor body 10 is thus produced for example by sintering.

In the shown exemplary embodiments, the rotor axis 9 of the rotor body 10 forms the outer axis 5, 5*a* of the first gerotor stage 2, 2*a* and the inner axis 3, 3*b* of the second gerotor stage 2, 2*b*. The rotor axis 9 of the rotor body 10 is thus arranged in such a manner that a parallel operation of both transmission stages 10 is made possible. As is evident from the FIGS. 1 to 3, the outer rotor 6, 6*b* of the second gerotor stage 2, 2*b* shown in the exemplary embodiments is arranged so as to enclose the rotor body 10. This means that the outer rotor 6, 6*b* of the second gerotor stage 2, 2*b* encloses the rotor body 10 radially outside. Thus, the first gerotor stage 2, 2*a* is a radially inner gerotor stage 2, 2*a* and the second gerotor stage 2, 2*b* a radially outer gerotor stage 2, 2*b* of the gerotor device 1.

Figure 5:
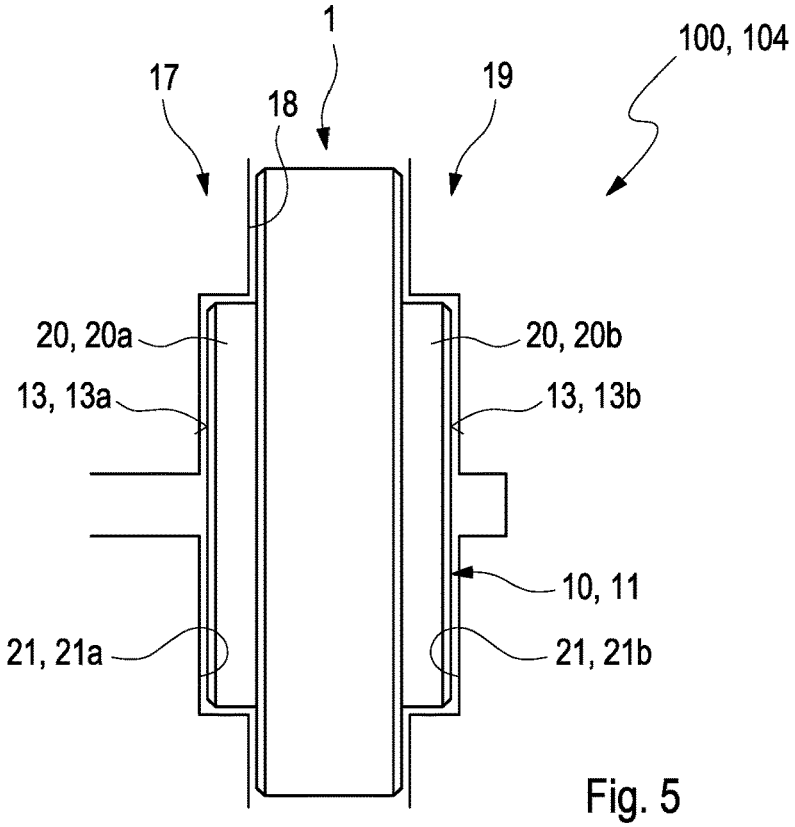

In the shown exemplary embodiments, the gerotor device 1 comprises a housing 15 merely shown in the FIGS. 3 and 5, in which gerotor stages 2 are received. The housing 15 comprises a housing pot 17 and a radially extending pot bottom 18 and a housing cover 19 closing the housing pot 17 and is located axially opposite the pot bottom 18.

As is evident from the FIGS. 2 to 5, the tooth gaps 8 of the gerotor stages 2 and thus the gerotor stages 2 are fluidically sealed against one another and relative to the surrounding area. In this way, internal leakages of the gerotor device 1 are avoided or at least reduced. In addition it is avoided in this way that the gerotor stage 2 operated at a lower pressure level, in particular the tooth gaps 8 of the gerotor stage 2 operated with the lower pressure level, suctions air from the surrounding area or such a suctioning is at least reduced.

In the exemplary embodiment shown in the FIGS. 1 to 3, the rotor body, for sealing the tooth gaps 8, comprises at least on an axial front side 14, an axially open and circumferential groove 14, wherein the groove 14 is merely indicated in FIG. 1.

In the exemplary embodiment shown in the FIGS. 1 and 2, the rotor body 10, on an axial front side 14, comprises an axially open and circumferential groove 14, which for sealing the tooth gaps 18 is filled with a liquid, in particular with oil.

In the exemplary embodiment shown in FIG. 3, the rotor body 10 comprises on at least one axial front side 13 an axially open and circumferential groove 14. In addition, the housing 15 comprises for the respective at least one groove 14 an axially projecting and circumferential rib 16, which for sealing the tooth gaps 8 engages in the associated groove labyrinth seal. In the exemplary embodiment shown in FIG. 3, the rotor body 10 comprises on the 14. The groove 14 and the associated rib 16 interact in the manner of a respective front side 13 a groove 14 and the housing 15 for the respective groove 14, an associated rib 16. In the shown exemplary embodiment, the rotor body 10 comprises a first front side 13, 13*a* located axially opposite the pot bottom 18, with a first groove 14, 14*a* and the housing pot 17 a first rib 16, 16*a* axially projecting from the pot bottom, which engages in the first groove 14, 14*a*. In addition, the rotor body 10 comprises a second front side 13, 13*b* located axially opposite the housing cover 19 with a second groove 14, 14*b* and the housing cover 19 an axially projecting second rib 16, 16*b*, which engages in the second groove 14, 14*b*.

In the exemplary embodiments shown in the FIGS. 1 to 3, the teeth 7, 7*a* and the tooth gaps 8, 8*a* of the rotor body 10 are arranged at the same axial height. As is evident in particular from FIG. 2, the first inner rotor 4, 4*a*, the rotor body 10 as well as the second outer rotor 6, 6*b* terminate axially identically in these exemplary embodiments, are thus situated axially in a radial plane. Thus, a compact construction of the gerotor device 1 is achieved.

Figure 4:
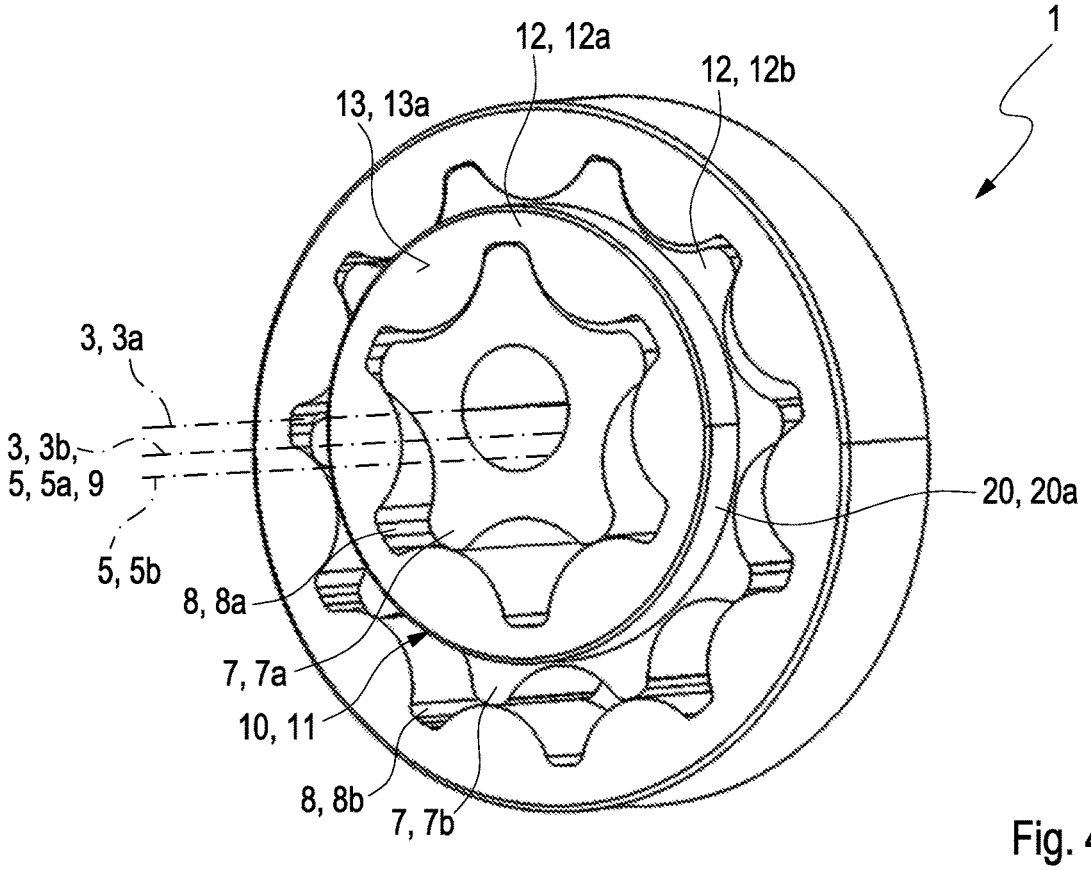

The exemplary embodiment shown in the FIGS. 4 and 5 differs from the exemplary embodiments shown in the FIGS. 1 to 3 in that the rotor body 10, on at least one of the axial front sides 13, is formed axially stepped. Thus, the rotor body 10 comprises on the front side 13 at least two steps 12 radially offset relative to one another, which axially merge into one another. In the shown exemplary embodiment, the rotor body 10 comprises two such steps 12, namely a radially inner step 12, 12*a* and a radially outer step 12, 12*b*. The radially inner step 12, 12*a* protrudes over the radially outer step 12, 12*b* of the rotor body 10 and the outer rotor 6, 6*b* of the second gerotor stage 2, 2*b* axially. By contrast, the radially inner step 12, 12*a* terminates axially on the front side with the outer rotor 6, 6*b* of the second gerotor stage 2, 2*b*. Thus, the rotor body 10 comprises on the stepped front side 13 an axially projecting and cylindrical portion 20, which in the following is also referred to as cylinder portion. The cylinder portion 20 protrudes over the second gerotor stage 2, 2*b* axially. In addition, the tooth gaps 8 in the cylinder portion 20 are at least partially formed so that the tooth gaps 8 extend into the cylinder portion 20. In the shown exemplary embodiments, the first tooth gaps 8, 8*a* thus extend into the cylinder portion 20. For sealing the teeth 8, the housing 15, as is merely shown in FIG. 5 in a simplified manner, comprises for the respective cylinder portion 20 an associated receptacle 21, in which the cylinder portion 20 for sealing the tooth gaps 8 engages axially. The cylinder portion 20 is sealed in the associated receptacle 21. In addition, the cylinder portion 20 and thus the rotor body 10 can be mounted in the associated receptacle 21 via the cylinder portion 20.

As is evident from FIG. 5, the rotor body 10, in the shown exemplary embodiment, comprises one such cylinder portion 20 on the respective front side 13. Thus, the rotor body 10 comprises a first cylinder portion 20, 20*a* projecting axially in the direction of the pot bottom 18 and the housing pot 17 a first receptacle 21, 21*a* directed axially to the inside, in which the cylinder portion 20, 20*a* engages axially. In addition, the rotor body 10 comprises a second cylinder portion 20, 20*b* projecting axially in the direction of the housing cover 19 and the housing cover 19 a second receptacle 21, 21*b* directed axially to the inside, in which the second cylinder portion 20, 20*b* engages axially.

Further, the exemplary embodiment shown in the FIGS. 4 and 5 differs from the exemplary embodiments shown in the FIGS. 1 to 3 in that the tooth gaps 8, 8*b* of the rotor body 10 axially protrude over the teeth 7, 7*a* of the rotor body 10. In the shown exemplary embodiment, the teeth 7, 7*a* of the rotor body 10 axially project out of the second outer rotor 6, 6*b*. Further, the first teeth 7, 7*a* project axially out of the second outer rotor 6, 6*b*. The first teeth 7, 7*a* and the first tooth gaps 8, 8*a* can thus have an axially greater extent than the second teeth 7, 7*b* and the second tooth gaps 8, 8*b*. Thus, it is possible for example with the gerotor stage 2, 2*a* to transmit greater moments than with the second gerotor stage 2, 2*b*.

Figure 6:
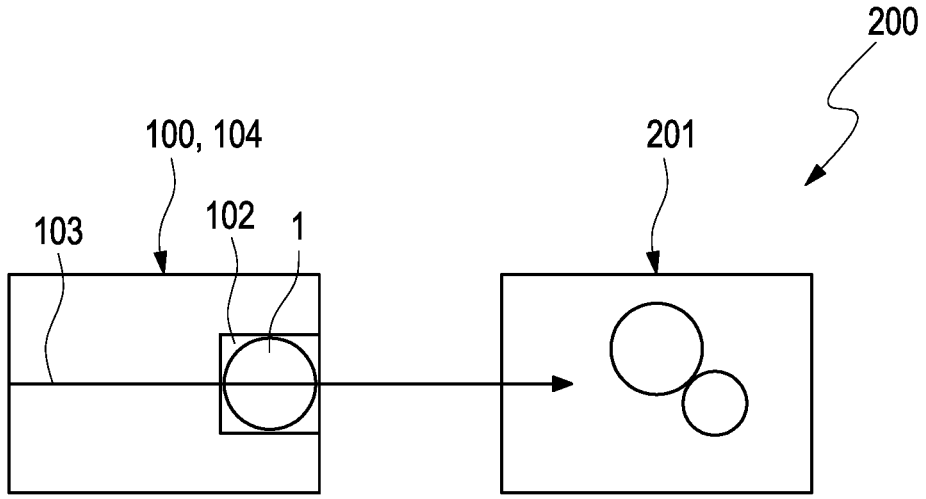
Figure 7:
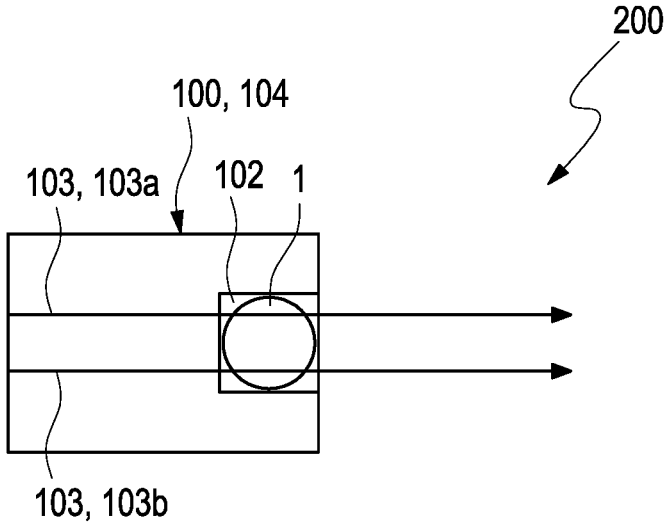

The pump apparatus 100, as is evident from FIG. 2 and indicated in the FIGS. 6 and 7, comprises a cavity 102 in which the gerotor device 1 is arranged and delivers at least one liquid during the operation. Thus, a flow path 103 indicated by arrows in the FIGS. 6 and 7 of the at least one liquid leads through the cavity 102.

According to FIG. 6, a single liquid can be delivered and thus pumped in a stepped manner with the gerotor device 1 by means of the gerotor stages 2. Thus, a flow path 103 leads through the cavity 22. According to FIG. 7, it is also possible with the gerotor device 1 to deliver two liquids or the same liquid in two separate circuits. In particular, the liquids can be delivered in the circuits with different pressures or volumetric flows. Thus, a gerotor stage 2 is provided for the respective liquid. Accordingly, a first flow path 103, 103*a* and a second flow path 103, 103*b* leads through the cavity 102.

According to FIG. 6, the pump apparatus 100 can be employed in a motor vehicle 200. In the motor vehicle 200, the pump apparatus 100 can supply for example a transmission 201 with oil and/or lubricant as liquid, thus supply oil and/or lubricant to the transmission. Thus, the pump apparatus 100 can be in particular an oil pump 104.

The invention claimed is:

1. A gerotor device for a pump apparatus, comprising:

at least two gerotor stages, wherein the at least two gerotor stages respectively comprises an inner rotor rotating during operation about an inner axis with teeth projecting radially outside and an outer rotor rotating during operation about an outer axis radially offset relative to the inner axis with radially inner open tooth gaps, in which the teeth of the inner rotor engage, a rotor body rotating during operation about a rotor axis comprises radially open tooth gaps of a first gerotor stage and teeth projecting radially outside of a second gerotor stage, a housing that receives the at least two gerotor stages, wherein the tooth gaps of the at least two gerotor stages are fluidically sealed at least one of against one another and relative to a surrounding area, and wherein the rotor body on at least one axial front side comprises an axially open and circumferential groove, and the housing comprises an axially projecting and circumferential rib, which for sealing the tooth gaps engages in the axially open and circumferential groove.

2. The gerotor device according to claim 1, wherein the rotor body, on another axial front side, comprises an axially open and circumferential groove, which for sealing is filled with a liquid.

3. The gerotor device according to claim 1, wherein:

the housing comprises a housing pot with a radially extending pot bottom and a housing cover closing the housing pot and located axially opposite the pot bottom, the rotor body comprises a first front side located axially opposite the pot bottom with a first groove and the housing pot comprises a first rib projecting axially from the pot bottom, which engages in the first groove, and the rotor body further comprises a second front side located axially opposite the housing cover with a second groove and the housing cover comprises an axially projecting second rib, which engages in the second groove.

4. The gerotor device according to claim 1, wherein:

the rotor body, on at least one axial front side, comprises a cylinder portion projecting radially inside and axially, in which the tooth gaps are at least partially formed, and which protrudes over the second gerotor stage axially, and the housing for the cylinder portion comprises an associated receptacle in which the cylinder portion for sealing the tooth gaps engages axially.

5. The gerotor device according to claim 4, wherein:

the housing comprises a housing pot with a radially extending pot bottom and a housing cover closing the housing pot and located axially opposite the pot bottom, the rotor body comprises a first cylinder portion projecting axially in a direction of the pot bottom and the housing pot comprises a first receptacle directed axially to the inside, in which the first cylinder portion engages axially, the rotor body comprises a second cylinder portion projecting axially in a direction of the housing cover and the housing cover comprises a second receptacle directed axially to the inside, in which the second cylinder portion engages axially.

6. The gerotor device according to claim 1, wherein the rotor body forms the inner rotor of the first gerotor stage and the outer rotor of the second gerotor stage.

7. The gerotor device according to claim 1, wherein the rotor body is structured monolithically.

8. The gerotor device according to claim 1, wherein the rotor body is a sintered component.

9. A pump apparatus for pumping at least one liquid, comprising:

a cavity, through which at least one flow path leads, and a gerotor device arranged in the cavity, which during operation delivers the at least one liquid, the gerotor device including:

at least two gerotor stages that respectively comprise an inner rotor rotating during operation about an inner axis with teeth projecting radially outside, and an outer rotor rotating during operation about an outer axis radially offset relative to the inner axis with radially inner open tooth gaps, in which the teeth of the inner rotor engage;

a rotor body rotating during operation about a rotor axis comprises radially open tooth gaps of a first gerotor stage of the at least two gerotor stages and teeth projecting radially outside of a second gerotor stage of the at least two gerotor stages;

a housing that receives the at least two gerotor stages;

wherein the tooth gaps of the at least two gerotor stages are fluidically sealed at least one of against one another and relative to a surrounding area; and wherein the rotor body on at least one axial front side comprises an axially open and circumferential groove, and the housing comprises an axially projecting and circumferential rib, which for sealing the tooth gaps engages in the axially open and circumferential groove.

10. The pump apparatus according to claim 9, wherein the rotor body, on another axial front side, comprises an axially open and circumferential groove, which for sealing is filled with oil.

11. The pump apparatus according to claim 9, wherein:

the housing comprises a housing pot with a radially extending pot bottom and a housing cover closing the housing pot and located axially opposite the pot bottom;

the rotor body comprises a first front side located axially opposite the pot bottom with a first groove and the housing pot comprises a first rib projecting axially form the pot bottom, which engages in the first groove; and the rotor body comprises a second front side located axially opposite the housing cover with a second groove and the housing cover comprises an axially projecting rib, which engages in the second groove.

12. The pump apparatus according to claim 9, wherein:

the rotor body on at least one axial front side comprises a cylinder portion projecting radially inside and axially, in which the tooth gaps are at least partially formed, and which protrudes over the second gerotor stage axially; and the housing for the cylinder portion comprises an associated receptacle in which the cylinder portion for sealing the tooth gaps engages axially.

13. The pump apparatus according to claim 12, wherein:

the housing comprises a housing pot with a radially extending pot bottom and a housing cover closing the housing pot and located axially opposite the pot bottom;

the rotor body comprises a first cylinder portion projecting axially in a direction of the pot bottom and the housing pot comprises a first receptacle directed axially to the inside, in which the first cylinder portion engages axially; and the rotor body comprises a second cylinder portion projecting axially in a direction of the housing cover and the housing cover comprises a second receptacle directed axially to the inside, in which the second cylinder portion engages axially.

14. The pump apparatus according to claim 9, wherein the rotor body forms the inner rotor of the first gerotor stage and the outer rotor of the second gerotor stage.

15. The pump apparatus according to claim 9, wherein the rotor body is structured monolithically.

16. A motor vehicle, comprising:

a transmission and a pump apparatus, wherein the pump apparatus during operation supplies a liquid to the transmission;

the pump apparatus including a gerotor device, the gerotor device including:

at least two gerotor stages that respectively comprise an inner rotor rotating during operation about an inner axis with teeth projecting radially outside, and an outer rotor rotating during operation about an outer axis radially offset relative to the inner axis with radially inner open tooth gaps, in which the teeth of the inner rotor engage;

a rotor body rotating during operation about a rotor axis comprises radially open tooth gaps of a first gerotor stage of the at least two gerotor stages and teeth projecting radially outside of a second gerotor stage of the at least two gerotor stages;

a housing that receives the at least two gerotor stages;

wherein the tooth gaps of the at least two gerotor stages are fluidically sealed at least one of against one another and relative to a surrounding area; and wherein the rotor body on at least one axial front side comprises an axially open and circumferential groove, and the housing comprises an axially projecting and circumferential rib, which for sealing the tooth gaps engages in the axially open and circumferential groove.

17. The motor vehicle according to claim 16, wherein the rotor body, on another axial front side, comprises an axially open and circumferential groove, which for sealing is filled with oil.

18. The motor vehicle according to claim 16, wherein the rotor body forms the inner rotor of the first gerotor stage and the outer rotor of the second gerotor stage.

19. The motor vehicle according to claim 16, wherein:

the housing comprises a housing pot with a radially extending pot bottom and a housing cover closing the housing pot and located axially opposite the pot bottom;

the rotor body comprises a first front side located axially opposite the pot bottom with a first groove and the housing pot comprises a first rib projecting axially form the pot bottom, which engages in the first groove; and the rotor body comprises a second front side located axially opposite the housing cover with a second groove and the housing cover comprises an axially projecting rib, which engages in the second groove.

* * * * *